United States Patent [19]

Ribas

[11] Patent Number: 4,519,724

[45] Date of Patent: May 28, 1985

[54] SYSTEM FOR ELASTICALLY ASSEMBLING TWO PIECES

[75] Inventor: Jean L. Ribas, Lyons, France

[73] Assignee: Majorette, Caluire, France

[21] Appl. No.: 506,251

[22] Filed: Jun. 20, 1983

[30] Foreign Application Priority Data

Jun. 29, 1982 [FR] France ..... 82 11871

[51] Int. Cl.[3] ..... B25G 3/00

[52] U.S. Cl. ..... 403/345; 446/115; 446/116; 52/578; 403/407

[58] Field of Search ..... 52/519, 578, 589, 593, 52/726, 275; 46/25, 28, 30; 63/3; 24/297, 573, 664, 679, 163 R; 403/353, 339, 345, 407

[56] References Cited

U.S. PATENT DOCUMENTS

| | | | |
|---|---|---|---|
| 1,437,867 | 12/1922 | Sixta | 46/25 |
| 2,841,919 | 7/1958 | McNeil | 46/30 |
| 3,452,959 | 7/1969 | Ishikawa | 52/578 X |
| 4,148,152 | 4/1979 | Barlow et al. | 46/17 X |

FOREIGN PATENT DOCUMENTS

| | | | |
|---|---|---|---|
| 96278 | 6/1963 | Denmark | 46/25 |
| 1150276 | 1/1958 | France . | |
| 2122822 | 1/1972 | France . | |

*Primary Examiner*—Dennis L. Taylor
*Attorney, Agent, or Firm*—Dowell & Dowell

[57] ABSTRACT

The present invention relates to a system for elastically assembling two identical pieces, wherein one of the ends of a piece comprises two lugs between which is disposed a bar in the form of an arc of circle, while the opposite end of this piece comprises a flange provided with two notches in which are engaged the lugs of a second, identical piece while the convex face of the bar abuts against the inner face of the flange. Beads on one piece engage in notches of the other piece to complete the assembly. The invention is particularly applicable to games and toys.

8 Claims, 11 Drawing Figures

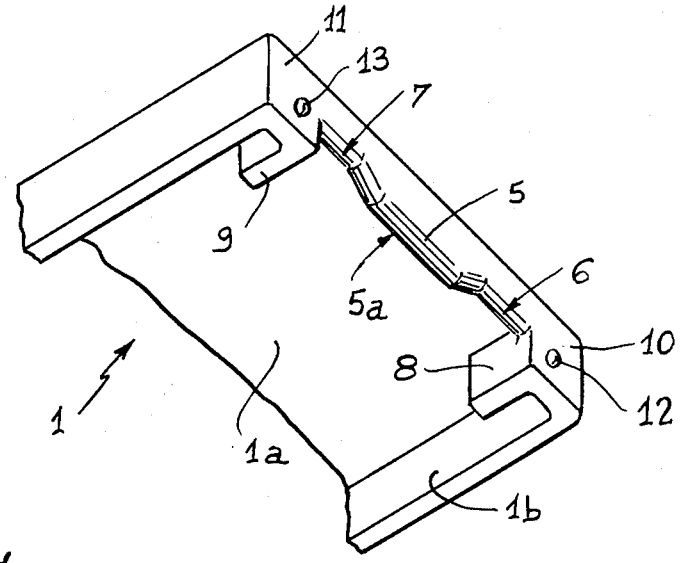
Fig. 6
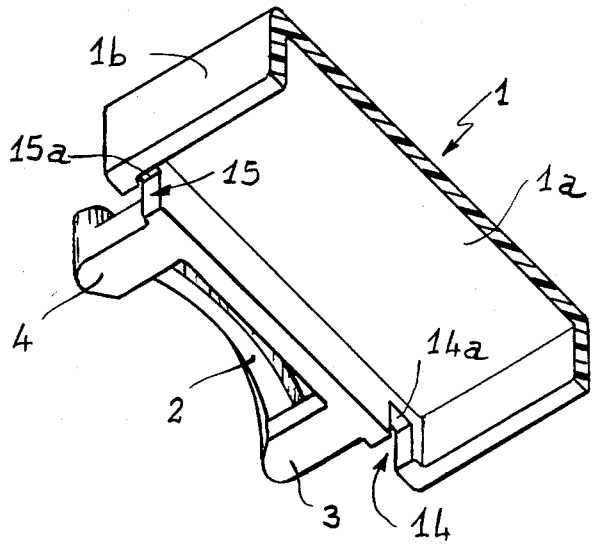

SYSTEM FOR ELASTICALLY ASSEMBLING TWO PIECES

The present invention relates to a system for assembling generally flat pieces so as to form either a rectilinear assembly or a closed configuration.

Known means for making such assemblies exist, which are generally constituted by hooks and retaining rings respectively formed at each end of the various elements to fasten them together. Such an assembly is disclosed in French Pat. No. 1 150 276. The main drawback of such assemblies is that they are rigid, with the result that they are frequently broken when manipulated in particular by small children.

French Pat. No. 2 122 822 discloses an assembly of two sections of track effected by means of an elastic band disposed alternately around lugs made on the opposite ends of two adjacent sections. This connection is, of course, elastic, but it is inconvenient since it is a long and difficult operation for young children to place the elastic band in position. Furthermore, the latter may slip from the lugs without warning since the immobilization of its ends is random.

It is an object of the improvements according to the present invention to overcome the above drawbacks and to produce a system for elastic assembly which ensures excellent fastening of two adjacent pieces whilst allowing easy dismantling without risk of breakage.

In addition, with the aid of the system of assembly according to the invention which comprises an elastic element, inclined planes may be provided, since the elements may be slightly offset angularly upwardly with respect to one another. Rails, tracks or other devices of the same type may thus be made by means of pieces assembled according to the system of the invention.

The system of assembly according to the invention is characterized in that one of the pieces comprises elastic means with which a rigid member of the other element cooperates.

To this end, the two elements of the system of assembly are located at the two ends of a piece, the first element comprising a bar in the form of an outwardly concave arc of circle disposed between the ends of two axial lugs issuing from the relevant end of the piece in question, whilst the second element of the system comprises at the opposite end of the piece a flange provided with two notches through which pass the lugs of the first element so that the bar of the latter comes elastically into abutment against the inner face of said flange.

According to a preferred embodiment, the outer face of the flange of the first element bears, outside the notches, two projections which each clip into a depression made in register therewith in the second element of the system.

The invention will be more readily understood on reading the following description with reference to the accompanying drawings, in which:

FIG. 6 is a partial exploded view in perspective of the two opposite ends of two adjacent pieces made according to a modification.

Figure 1:
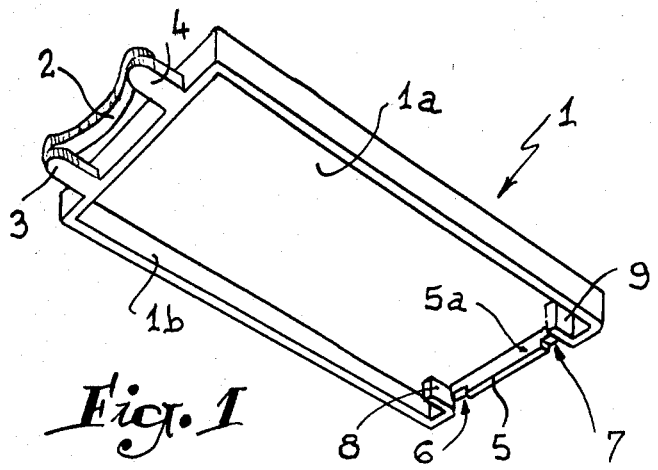
FIG. 1 is a view in perspective from underneath a piece of which each of the ends is provided with an element of the system of assembly according to the invention.

Referring now to the drawings, FIG. 1 shows one of the pieces of an assembly which is made up in accordance with the invention. This piece is in the form of a rectangular plate 1 comprising a top 1*a* and a peripheral partition 1*b*.

Each of the two ends of the piece 1 is provided with one of the elements of the system of assembly according to the invention. The first element is essentially constituted by a bar 2 in the form of an arc of circle whose concavity is oriented outwardly. This bar is disposed between the ends of two lugs 3, 4 extending axially from the outer face of that part of the peripheral partition 1*b* located at the relevant end of the piece 1. The bar 2 is disposed in the axis of symmetry of the end in question; it is offset upwardly since it is situated above the lugs 3–4, with the result that it is located above the plane determined by the free edge of the peripheral partition 1*b*.

The second element of the assembly according to the invention is disposed at the opposite end of the piece 1. At this end the peripheral partition 1*b* is reduced so as to constitute a rigid flange 5 whose height is less than that of said partition. This flange has two notches 6, 7 hollowed out therein, the distance therebetween corresponding to that between the lugs 3, 4. The outer face of each notch is extended by an adjacent tab 8, 9, oriented longitudinally. At the end of the piece 1 which is associated with the second element of the system of assembly according to the invention, the peripheral partition 1*b* extends only over a small part of the side in question, then it extends as tabs 8, 9.

Figure 2:
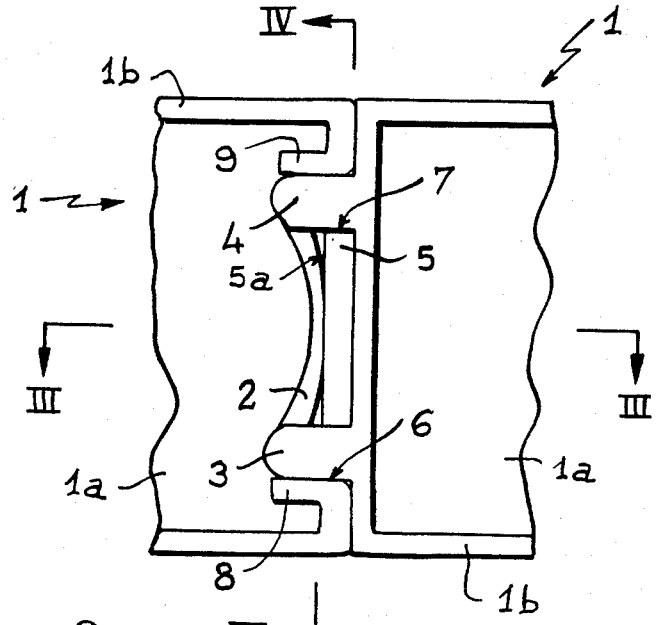
FIG. 2 illustrates the junction of two pieces effected by means of a system of assembly according to the invention.

When it is desired to assemble two elements identical to the one illustrated in FIG. 1, the connection shown in FIG. 2 is obtained, which results from the engagement of the two lugs 3 and 4 in notches 6 and 7, respectively, the convex side of the bar 2 abutting against the inner face 5*a* of the flange 5. It will be observed that the longitudinal tabs 8 and 9 serve as guide for the lugs 3 and 4.

Figure 3:
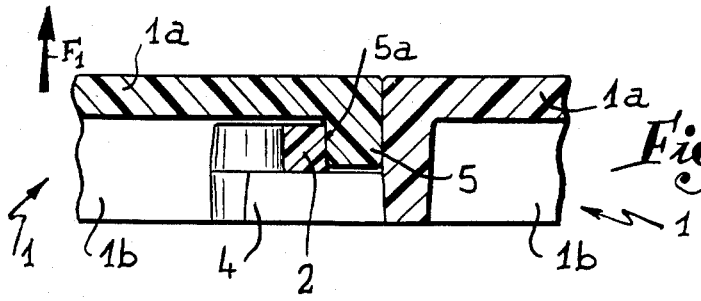
FIGS. 3 and 4 are sections thereof along III—III and IV—IV (FIG. 2).
Figure 4:
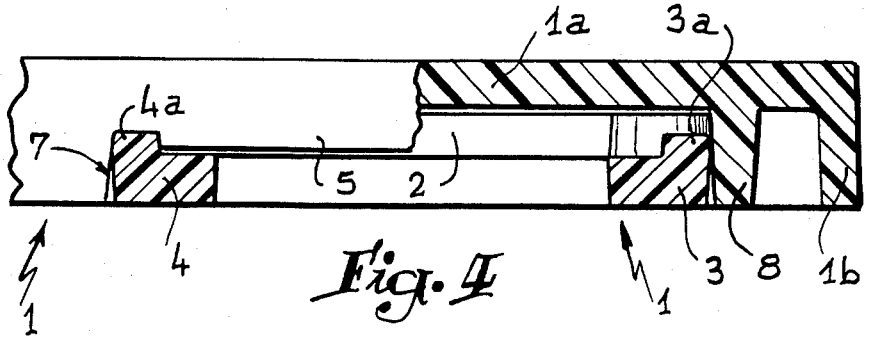

FIGS. 3 and 4 show the location of the different components of the system of assembly in a vertical plane. The total height of the lugs 3 and 4 and of the bar 2 is noted to be substantially equal to the height of the peripheral partition 1*b*, in other words so that the upper face of said bar is located just below the lower face of the top 1*a* of the adjacent element and the height of the flange 5 of the latter corresponds to thickness of the bar 2. FIG. 4 shows the exact cross section of each lug 3, 4 whose upper face comprises a shoulder so that it is in fact beads 3*a*, 4*a* of the lugs which penetrate in the notches 6, 7.

Figure 5:
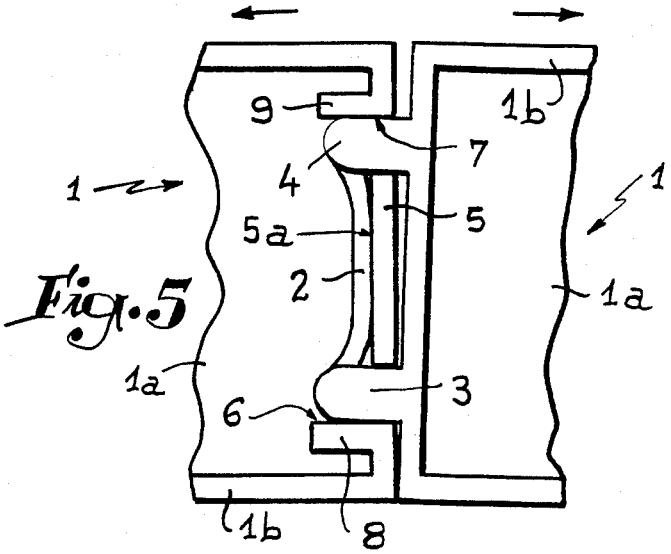
FIG. 5 is a view similar to that of FIG. 2, but illustrating the deformation of the concave bar when tension is exerted on the system of assembly according to the invention.

Finally, FIG. 5 shows how the bar 2 is deformed when two adjacent elements are subjected to tension which is in the nature of a torque as shown by arrows above the figure since the ends of said elements form an angle. Noting the small height of the bar 2 and the corresponding flange 5, such tensioning automatically brings about a disengagement of the flange with respect to the face of the other piece since this movement is not usually effected in space in a plane strictly containing the two pieces 1.

With reference to FIG. 3, it will be observed that if the left-hand piece is displaced slightly in the direction of arrow F1, i.e. by subjecting it to a rotation about its flange 5, the bar 2 is deformed with the result that the flange is disengaged from the bar virtually immediately without it being damaged. Under these conditions, elements similar to element 1 may be assembled and dismantled virtually ad infinitum without detriment to correct assembly thereof.

According to a preferred embodiment, the two zones 10 and 11 of the peripheral partition 1*b* located outside the tabs 8 and 9 comprise a projection in the form of a stud 12, 13 (FIG. 6).

Figure 8:
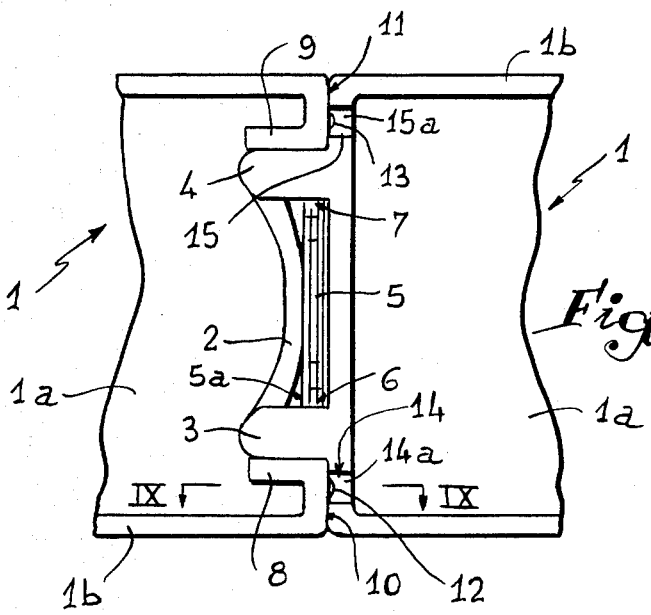
FIG. 8 is a view similar to that of FIG. 2, but showing the modification of FIG. 6.
Figure 9:
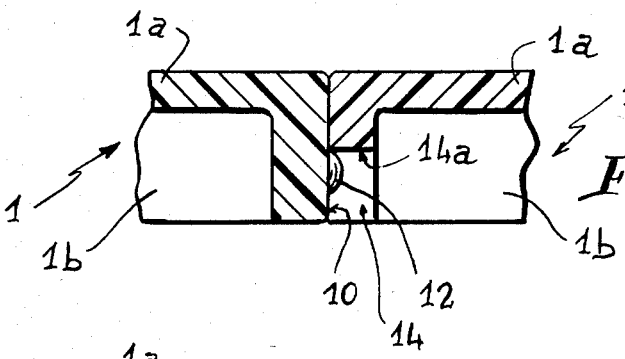
FIG. 9 is a section thereof along IX—IX (FIG. 8) showing the projection engaged in the corresponding depression in the adjacent piece.
Figure 7:
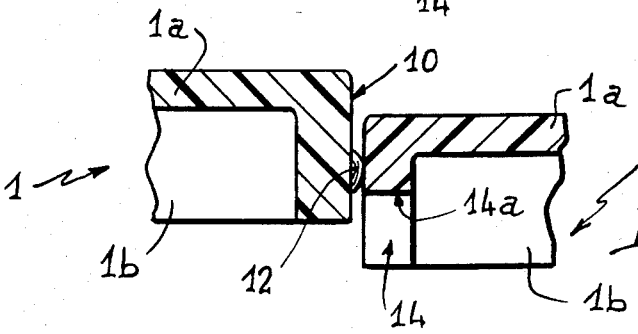
FIG. 7 shows in detail, on a larger scale, the positioning of one of the projections at the end of the piece bearing the male member.

The peripheral partition comprises on either side of the lugs 3 and 4 a notch 14, 15 opening outwardly of the edge of the partition but whose depth is less than the height of the latter. As illustrated in FIG. 7, when the two opposite ends of two adjacent pieces 1 are to be assembled as explained hereinabove, the studs 12 and 13 bear against the outer face of the peripheral partition 1*b* (FIG. 7), then they slip into the notches 14,15 as the latter are located exactly opposite the studs (FIG. 8). The position of the latter with respect to the edge of the peripheral partition is such that, once the upper faces of the two elements 1 are aligned, the studs abut against the bottom 14*a*, 15*a* of the notches 14, 15 (FIG. 9).

It goes without saying that the cooperation of the studs with the outer face of the peripheral partition as illustrated in FIG. 7 is possible due to the elastic deformation of the corresponding bar 2 since, at that moment, the piece bearing the studs moves away from the other.

The studs in question consequently provide additional locking which considerably improves assembly without being detrimental to the ease of dismantling thereof due to the spherical form of the studs. Nor do they prevent two adjcent pieces from being angularly offset to constitute an inclined plane.

Figure 10:
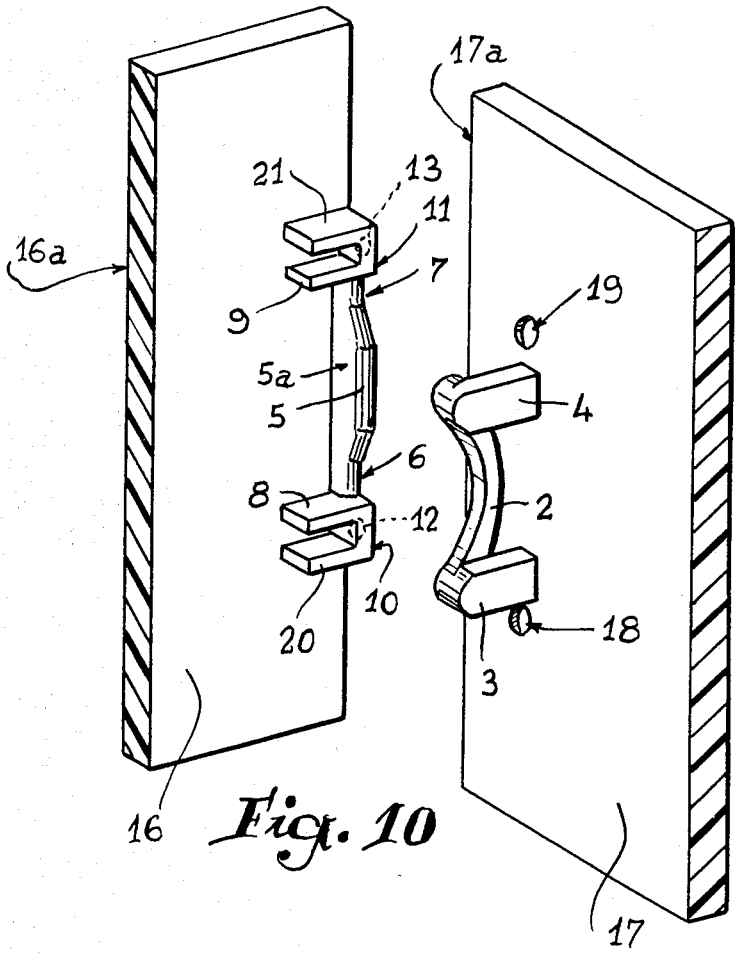
FIG. 10 illustrates how a system according to the invention may be adapted to join two pieces oriented perpendicularly to each other.
Figure 11:
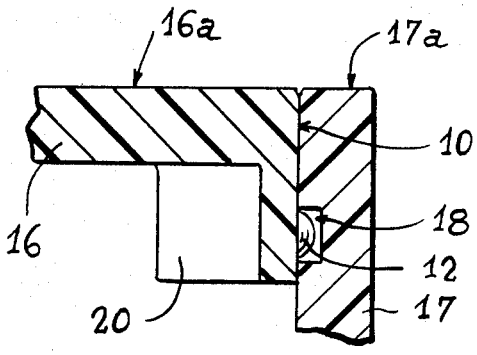
FIG. 11 is a view similar to that of FIG. 9 but relating to the embodiment of FIG. 10.

As illustrated in FIG. 10, each element of the system of assembly according to the invention may be associated with the end of two perpendicular pieces 16, 17 which are to be assembled. To this end, the assembly element comprising the rigid member or flange 5 is located at the end of the piece 16 in the position strictly identical to that which it occupies when two flat elements are joind end to end as illustrated in the previous Figures. On the other hand, the second element, i.e. the one which comprises the elastic bar 2 and the two lugs 3 and 4 is arranged perpendicularly to the piece 17 at such a distance from the edge 17*a* of the latter that, once assembly is effected, the edge is located in line with the outer face 16*a* of the piece 16. It will be noted that the notches 14 and 15 are replaced by two depressions 18, 19 in which the studs 12 and 13 engage at the end of penetration of the flange 5 under the bar 2.

To facilitate comprehension, FIG. 10 illustrates the zones 10 and 11 located on either side of the flange 5 and on which the beads 12 and 13 are located. Although this is not compulsory, two cheeks 20, 21 are provided, which are parallel to tabs 8 and 9 which extend the zones 10 and 11.

What is claimed is:

1. A system for removably assembling two generally flat plate pieces having opposite ends having mutually opposed surfaces, comprising:

(a) on a first surface adjacent the end of the first piece, a first assembly element comprising a pair of lugs spaced apart transversely of the first surface and extending from the first surface toward the second piece, and a bar carried by the lugs and extending therebetween, the bar having an arcuate face which extends convexly toward the first surface and is spaced therefrom; and (b) at the opposed end of the second piece, a second assembly element comprising a transverse flange extending at right angles from the plate and presenting an end surface to oppose said first surface of the first piece, the flange having a pair of transversely spaced notches extending therethrough and shaped to receive said lugs when the pieces are assembled with the flange located between said face of the bar and said first surface.

2. An assembly system as claimed in claim 1, wherein the height of the flange as measured from the surface of the plate from which it extends is equal to the thickness of the bar as measured in the same direction when said elements are assembled.

3. An assembly system as claimed in claim 1, wherein the second assembly element further comprises tabs extending at right angles to the flange and disposed to lie along the surfaces of the lugs when said elements are assembled.

4. An assembly system as claimed in claim 1, wherein the bar is supported on one side of the lugs so that it is offset therefrom toward the surface of the second plate when said elements are assembled.

5. An assembly system as claimed in claim 4, wherein said one side of each lug has a bead on it adjacent to the bar, and each notch is shaped to receive a bead.

6. An assembly system as claimed in claim 1, wherein said end surface of the second assembly element and the opposed first surface of the first piece respectively carry mutually opposing projection and depressing means which interlock when said elements are assembled.

7. An assembly system as claimed in claim 6, wherein said first surface of the first piece comprises a partition disposed at right angles to the plate at the end of said first piece, and said depression means comprise notches in the partition recessed therein to the level of the projection means on the surface of the second assembly element.

8. An assembly system as claimed in claim 6, wherein said first surface comprises the flat surface of the first plate near one end, and wherein said end surface of the second piece is disposed normal to the flat surface of the second plate, whereby said plates are disposed mutually perpendicular when said elements are assembled.

* * * * *